US005367714A

United States Patent [19]

Hines et al.

[11] Patent Number: 5,367,714

[45] Date of Patent: Nov. 29, 1994

[54] BELT WITH CONCEALED WHIP

[76] Inventors: Edmund L. Hines, 32 Crestwood, Sugar Land, Tex. 77478; John A. Onofrey, 8306 Highway 90A, P.O. Box 650, Sugar Land, Tex. 77487-0650

[21] Appl. No.: 69,442

[22] Filed: Jun. 1, 1993

[51] Int. Cl.[5] ..... A41F 9/00; B68B 11/00

[52] U.S. Cl. ..... 2/311; 2/312; 2/338; 231/2.1

[58] Field of Search ..... 2/300, 301, 302, 304, 2/305, 310, 311, 312, 338, 306, 307, 308, 309, 313, 314, 335, 315, 334, 316, 333, 317, 318, 319, 320, 321, 322, 323, 324, 325, 326, 327, 328, 329, 330, 331, 332; 119/861

[56] References Cited

U.S. PATENT DOCUMENTS 308,017 11/1884 Turner ..... 231/5
559,970 5/1896 Dreyfus ..... 2/338
2,342,066 2/1944 Tramill ..... 119/861
4,062,066 12/1977 Weiss ..... 2/322
4,863,095 9/1989 Crane ..... 231/2.1

FOREIGN PATENT DOCUMENTS 1560071 1/1980 United Kingdom ..... 2/300

*Primary Examiner*—Jeanette E. Chapman
*Attorney, Agent, or Firm*—Bush, Moseley & Riddle

[57] ABSTRACT

A personal protection device includes a belt which conceals a whip in an internal sheath formed therein. The whip has a handle which also is concealed by an end portion of the belt. The whip can be quickly and easily withdrawn from the sheath in the belt by releasing the end portion and grasping the handle, all in a substantially single motion. The whip material allows sufficient flexibility to be worn comfortably around the waist, but is rigid enough to be an effective striking device. Embodiments for sports and uniform use are disclosed.

17 Claims, 1 Drawing Sheet

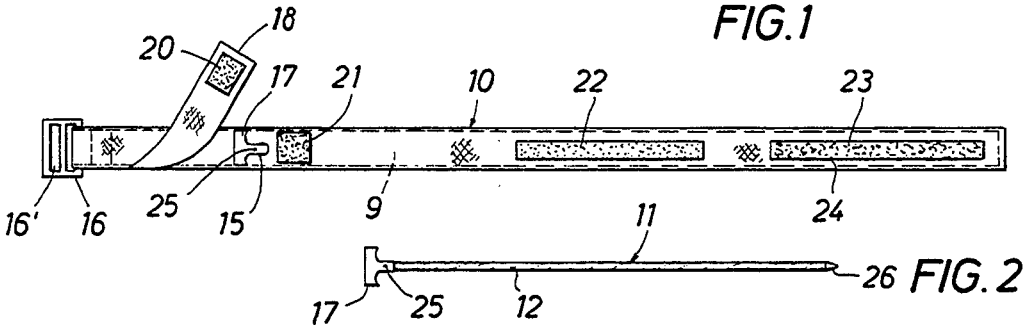
FIG. 1
FIG. 2
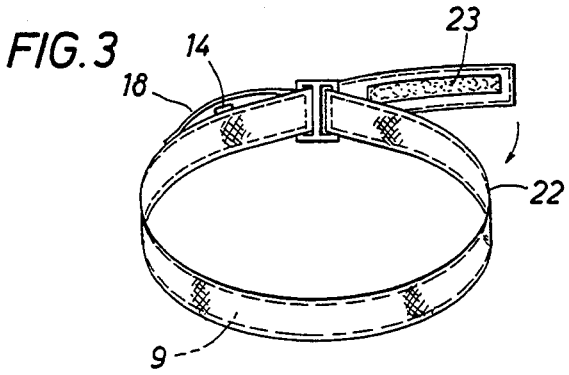
FIG. 3
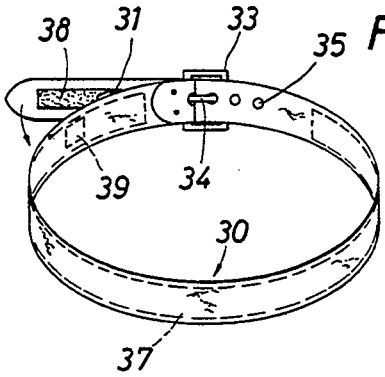
FIG. 5
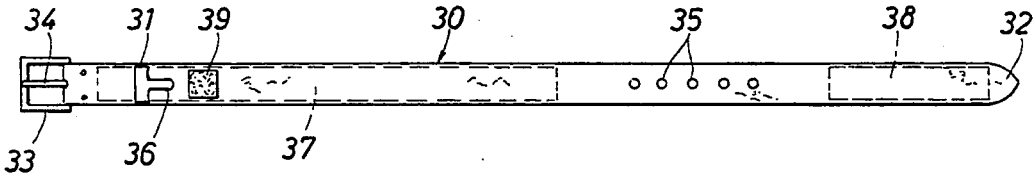
FIG. 4
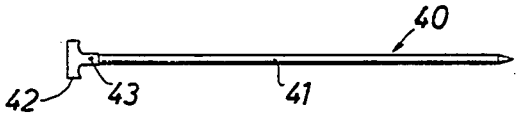
FIG. 6
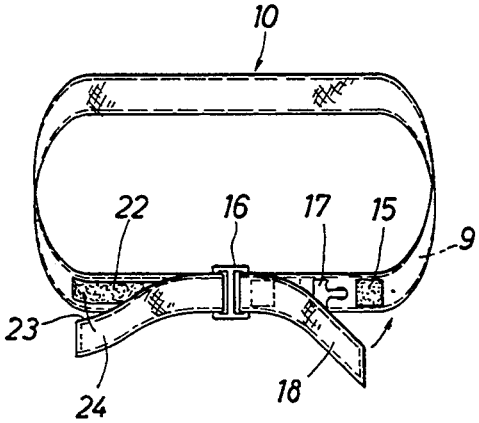
FIG. 7
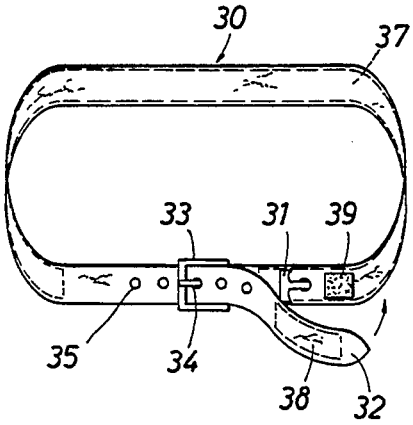
FIG. 8

BELT WITH CONCEALED WHIP

FIELD OF THE INVENTION

This invention relates generally to a belt that houses a concealed weapon that can be used by joggers, walkers, cyclists, law enforcement and security officers, and military personnel as a protection against uncontrolled animals and human beings, and particularly to a belt that is worn around the waist and conceals a quick draw whip that can be used for defensive purposes when the need arises.

BACKGROUND OF THE INVENTION

Prior art devices of this general type have included belts, whips and canes that have been used to strike attackers. Knives hidden inside belts and whips hidden inside walking canes also have been suggested, however these devices have a number of drawbacks. For example, a knife hidden within a belt as disclosed by U.S. Pat. Nos. 3,823,422 and 4,313,230, does not offer much in the way of reach, and a whip hidden in a walking cane as shown in U.S. Pat. No. 918,557 is cumbersome and requires the constant use of the hands to carry the weapon. A belt used as a weapon does not offer those quick draw qualities or striking potential that are desirable. Most of these devices are insufficient in length, cumbersome to carry, and are unwieldy and impractical when used as a defensive weapon.

Thus there remains a need for an article of apparel, particularly a belt, which conceals a weapon of sufficient length that it has a considerable reach advantage. Moreover the hands of the user should remain free and unobstructed prior to quick deployment of the weapon, which should be able to occur without interference from other articles of clothing or apparel such as trousers or belt loops.

It is the general object of the present invention to provide a new and improved belt-concealed whip that obviates the main shortcomings and disadvantages with prior devices noted above.

Another object of the present invention is to provide a new and improved belt-concealed whip which is simple and lightweight but sturdy in construction, and which is inexpensive to manufacture and easy to use.

Still another object of the present invention is to provide a new and improved device of the type described which can be carried in such a manner as to be unobtrusive, but is instantly available to a user for his or her defense in the event of an attack.

Yet another object of the present invention is to provide a new and improved device of the type described which, when drawn and used properly, can ward off an attack and, if needed, inflict pain and injury to an attacker.

SUMMARY OF THE INVENTION

These and other objects are attained in accordance with the concepts of the present invention through the provision of an article of apparel such as a belt that encircles the waist of the user and which is arranged to carry and conceal a whip having a "T-shaped" handle. For sport applications the belt preferably is made of nylon web material having inner and outer walls which provide an elongated sheath or pocket between them. An opening into such sheath is provided at an end thereof close to the belt loop, and the outer end of the whip is inserted into the sheath at such opening. Preferably the whip shaft is made of plastic coated steel strand or wire rope having a steel ferrule tip crimped on its outer end. The whip's shaft is shoved into the sheath, and its aluminum T-handle is concealed by a portion of the belt which is folded back over it and secured by Velcro hook and pile fasteners. The opposite end portion or tongue of the belt also is inserted through the loop, folded back and fastened by Velcro members to hold the belt comfortably around the waist. Instead of nylon web, the belt of the present invention can be fabricated out of leather for use with different wearing apparel or uniforms. In this case the tongue of the belt, after passing through a standard buckle, is fastened down over the whip handle to conceal the same. The shaft of the whip can be made of a material such as tubular nylon. In either case the whip can be quickly deployed in a single motion of the hand, which detaches the belt portion or tongue, grasps the handle, and pulls the whip out the of sheath.

BRIEF DESCRIPTION OF THE DRAWINGS

The present invention has other objects, features and advantages which will become more clearly apparent in connection with the following detailed description of a preferred embodiment, taken in conjunction with the appended drawings in which:

FIG. 1 is a front view of a belt and whip in accordance with the invention;

FIG. 2 is a front view of the whip included in FIG. 1;

FIG. 3 is a rear perspective view of the belt and whip shown in FIG. 1;

FIG. 4 is a view similar to FIG. 1 but of a leather belt construction;

FIG. 5 is a view similar to FIG. 3, but showing a leather belt;

FIG. 6 shows an alternative embodiment of a whip;

FIG. 7 is a front isometric view of the nylon belt and whip; and

FIG. 8 is a view similar to FIG. 7 but showing a leather belt construction.

DETAILED DESCRIPTION OF A PREFERRED EMBODIMENT

Referring initially to FIG. 1, an embodiment of this invention which is particularly suitable for sport-type clothing and applications includes a belt 10 and a whip 11. The belt 10 has two straps of nylon web sewn together near their upper and lower edges to form front and back walls which define between them an internal elongated sheath 9 which accommodates the staff 12 of the whip 11. An opening 15 is formed centrally in the outer web of the belt about 6–8 inches or so from the buckle 16, to allow the whip 11 to be inserted into the sheath 9. The handle 17 of the whip 11, which is generally "T" shaped, is seen exposed as a result of the securing flap 18 being unhinged. A Velcro hook pad 20 and pile pad 21 are used to releasably attach the flap 18 to the main body of the belt 10 at a location beyond the handle 17 so that the flap obscures or conceals the handle. Additional strips 22, 23 of Velcro material are employed to attach the belt to the buckle 16 at the opposite end portion of the belt. The outer end portion 24 of the belt, after being looped around the waist, is fed through the slot 16' in the buckle and turned rearward to where the fasteners 22, 23 can be engaged with the belt having a comfortable fit.

This particular construction is very durable and strong, and provides easy and fast access to the concealed whip 11 because the flap 18 can be released, the handle 17 grasped and the whip pulled out in almost one continuous motion of the hand. If desired, highly reflective material can be applied to the belt 10 to add more protection for a person who is wearing the invention at night.

As shown in FIG. 2, the whip 11 has a flexible shaft 12 made of a plastic coated stranded steel or wire rope. The inner end of the shaft 12 is inserted into a hole in the T-handle 17, and is secured thereto by a set screw 25 or the like. To prevent the outer end of the shaft from unravelling, a steel ferrule 26 is mounted and crimped onto the tip. The T-handle 17 can be made of cast aluminum to provide a sturdy, lightweight and corrosion resistant member.

FIG. 3 illustrates the invention as it would be worn around the waist. With the whip 11 in place, the wearer passes the belt portion having the fastener 23 through the right slot of the belt loop 16 and tightens the belt up until it is comfortably snug. Then the fastener 23 is pressed against the fastener 22. The whip 11 can be easily brought into action by raising the flap 18 to expose the T-handle 17. The whip 11 now can be drawn from its sheath in the belt 10 and used to strike an attacker in one swift motion which is quite effective in inflicting pain.

FIG. 4 illustrates an alternative embodiment of the present invention where the belt is made of leather. The belt 30 has a tongue 32 which passes through a standard buckle 33 in the usual manner. A keeper 34 goes through one of several holes 35, also as usual. A whip 35 is inserted into the belt 30 at 36 where a sheath 37 is formed by a double layer of leather. The T-handle 31 of the whip 35 is exposed on the front as shown. The belt tongue 32 when passed through the buckle 33 covers and thus conceals the handle 31 from view. A strip of Velcro fastener material 38 cooperates with another fastener pad 39 near the handle 31 to fasten the tongue 32 down.

FIG. 6 shows an alternative embodiment of a whip that is constructed in accordance with the present invention. Here the shaft 41 of the whip 40 is made of tubular nylon that is connected to the handle 42 by set screw 43.

FIG. 7 represents a front isometric view of the nylon web belt 10 as it would be worn about the waist of a user. The end portion 24 is passed through the buckle 16, however as illustrated the fastener material 23 has not yet been contacted with the fastener material 22, and the end portion 18 also is shown unhinged for purposes of illustration. When the portion 18 is fastened down, the T-handle 17 is snugly secured in its proper position and totally concealed from view. The portion 13 of the belt 10 can be easily unhinged and the whip 11 smoothly extracted from the opening 15 of its sheath 9 for use in a defensive manner.

FIG. 8 is a front isometric view of the leather belt 30 shown above, as it would be worn around the waist of a user. The long tongue 32 passes through the buckle 33 in the usual manner, and serves as a securing and concealment flap. The Velcro fasteners 36 and 37 are pressed together, which secures the T-handle 31 in its proper position and totally conceals same.

OPERATION

In operation of the embodiment shown in FIGS. 1–3, the whip 11 is inserted through the opening 15 and into the internal sheath 9 until the T-handle 17 is adjacent such opening. Then the belt 10 is positioned around the user's waist. The end portion 24 of the belt 10 having the fastener material 23 will have been inserted through the outer slot 16' in the buckle 16 and secured to the material 22. The end portion 18 then is inserted through the other buckle slot and the belt 10 is pulled comfortably tight, after which the Velcro material 20 is engaged with the material 21. Thus the end portion 18 completely conceals the T-handle 17 from view, and holds it against the belt.

When a need arises to use the whip 11, the right hand of the user pulls the fastener materials 20, 21 loose from one another, and in the same or substantially the same motion grasps the handle 17 and pulls the whip 11 out of its sheath. A backhand blow can be struck in this same motion, if need be.

The operation and use of the embodiment shown in FIGS. 4–7 is essentially the same, the principal difference being how the belt is captured around the waist by using the keeper 34 of standard buckle 33 and the belt holes 35. The elongated tongue 32 extends over the T-handle 31, and the Velcro fastener 38 is pressed against the fastener pad 39 to hold the tongue in place so that it conceals the handle 31.

It now will be recognized that a new and improved belt having a concealed, fast draw whip has been disclosed, and that the invention is uniquely adapted to ward off an attack by an uncontrolled person or animal. Since certain changes or modifications may be made in the disclosed embodiment without departing from the inventive concepts involved, it is the aim of the appended claims to cover all such changes and modifications falling within the true spirit and scope of the present invention.

What is claimed is:

1. A combination belt and whip having a belt which conceals a whip that is adapted to be used to ward off an attacker and said combination comprising: a belt having buckle means for securing said belt around the waist of a user; sheath means formed within said belt, said sheath means having an opening to the outside of said belt adjacent said buckle means; a whip inserted through said opening and concealed in said sheath means and having a handle located externally of said opening; said belt having an end portion extending from said buckle means which conceals said handle; said handle is shaped in a manner to enable it to be readily grasped so that the whip can be quickly pulled from said sheath.

2. The combination of claim 1 wherein said handle has a "T" shape to enable it to be readily grasped so that the whip can be quickly pulled from said sheath means.

3. The combination of claim 1 wherein said buckle means has parallel slots therethrough, said end portion extending through one of said slots and then in a reverse direction over said handle to conceal the same.

4. The belt of claim 1 wherein said buckle means has opposite sides and wherein said end portion extends through said buckle means from one of said sides to the other thereof and then over said handle to conceal the same.

5. The combination of claim 1 wherein said whip is constructed of a plastic coated wire rope so as to be easily withdrawn from said sheath means.

6. The combination of claim 5 further including a ferrule crimped on the outer end of said whip.

7. The combination of claim 1 wherein said whip is constructed of tubular plastic so as to be easily withdrawn from said sheath means.

8. The combination of claim 1 further including means for releasably attaching said end portion to an underlying belt surface.

9. The combination of claim 1 made of nylon web material.

10. The combination of claim 1 made of leather.

11. A combination belt and whip having a belt which conceals a whip therein for warding off an attack by an uncontrolled animal or human, the combination comprising: a belt arranged to encircle the waist of a user, said belt having outer and inner walls defining a sheath; an opening through said outer wall to enable said whip to be inserted therein to conceal said whip from view; said whip having a handle shaped in a manner to permit it to be easily grasped and disposed adjacent said opening; and an end portion of said belt arranged to cover said handle to conceal said handle from view.

12. The combination of claim 11 further including a buckle, said end portion passes through said buckle and then being folded back into a position where it covers said handle, and further including means for releasably attaching said end portion to an underlying portion of said belt.

13. The combination of claim 11 where said belt has an opposite end portion which passes through said buckle and then is folded back on an underlying portion of said belt; and further including means for releasably attaching said opposite end portion to said underlying portion.

14. The combination of claim 11 wherein said whip is a plastic covered wire rope section having means to prevent unravelling of its outer end.

15. A combination belt and whip having a belt which conceals a whip therein to ward off an attack by an uncontrolled human or animal, said combination comprising: a belt having a buckle at one end and a tongue portion at its opposite end, a section of said belt having outer and inner walls defining an internal sheath; and an opening into said sheath adjacent said buckle for allowing said whip to be inserted into said sheath where it is concealed from view; said whip having a handle shaped in a manner to permit it to be easily grasped and disposed externally of said sheath adjacent said opening; said tongue portion extending through said buckle and covering said handle so that both said handle and whip are concealed.

16. The combination of claim 11 further including means for releasably attaching said tongue portion to a front surface of said belt at a location that is on the opposite side of said handle from said buckle.

17. The combination of claim 16 wherein said whip is made of a tubular nylon rod.

* * * * *